US006693600B1

(12) United States Patent
Elliot

(10) Patent No.: US 6,693,600 B1
(45) Date of Patent: Feb. 17, 2004

(54) ULTRA-BROADBAND ANTENNA ACHIEVED BY COMBINING A MONOCONE WITH OTHER ANTENNAS

(76) Inventor: Paul G. Elliot, 367 Arlington St., Acton, MA (US) 01720

( * ) Notice: Subject to any disclaimer, the term of this patent is extended or adjusted under 35 U.S.C. 154(b) by 0 days.

(21) Appl. No.: 09/995,745

(22) Filed: Nov. 29, 2001

Related U.S. Application Data

(63) Continuation-in-part of application No. 09/676,671, filed on Nov. 24, 2000, now abandoned.

(51) Int. Cl.[7] ..... H01Q 13/00
(52) U.S. Cl. ..... 343/773; 343/715
(58) Field of Search ..... 343/715, 773, 343/752, 846, 848

(56) References Cited

U.S. PATENT DOCUMENTS 4,851,859 A * 7/1989 Rappaport ..... 343/773
5,923,299 A * 7/1999 Brown et al. ..... 343/773
5,990,845 A 11/1999 Sharp
6,154,182 A * 11/2000 McLean ..... 343/752
6,198,454 B1 3/2001 Sharp
6,337,664 B1 * 1/2002 Mayes et al. ..... 343/745
6,369,766 B1 * 4/2002 Strickland et al. ..... 343/713

* cited by examiner

*Primary Examiner*—Tan Ho
(74) *Attorney, Agent, or Firm*—Tom Hamill, Jr.

(57) ABSTRACT

A new type of antenna is provided by combining a single monocone with one or more additional antennas. The additional antennas are longer than the monocone, or they are chosen from a list of antennas. The inventive combination antenna has a greater frequency bandwidth than any of the component antennas would when employed singly. The new antenna has a single RF feed point. The monocone and the other component antennas are all electrically connected together close to said feed point. A monocone is also known as a conical monopole.

8 Claims, 8 Drawing Sheets

(2 of 8 Drawing Sheet(s) Filed in Color)

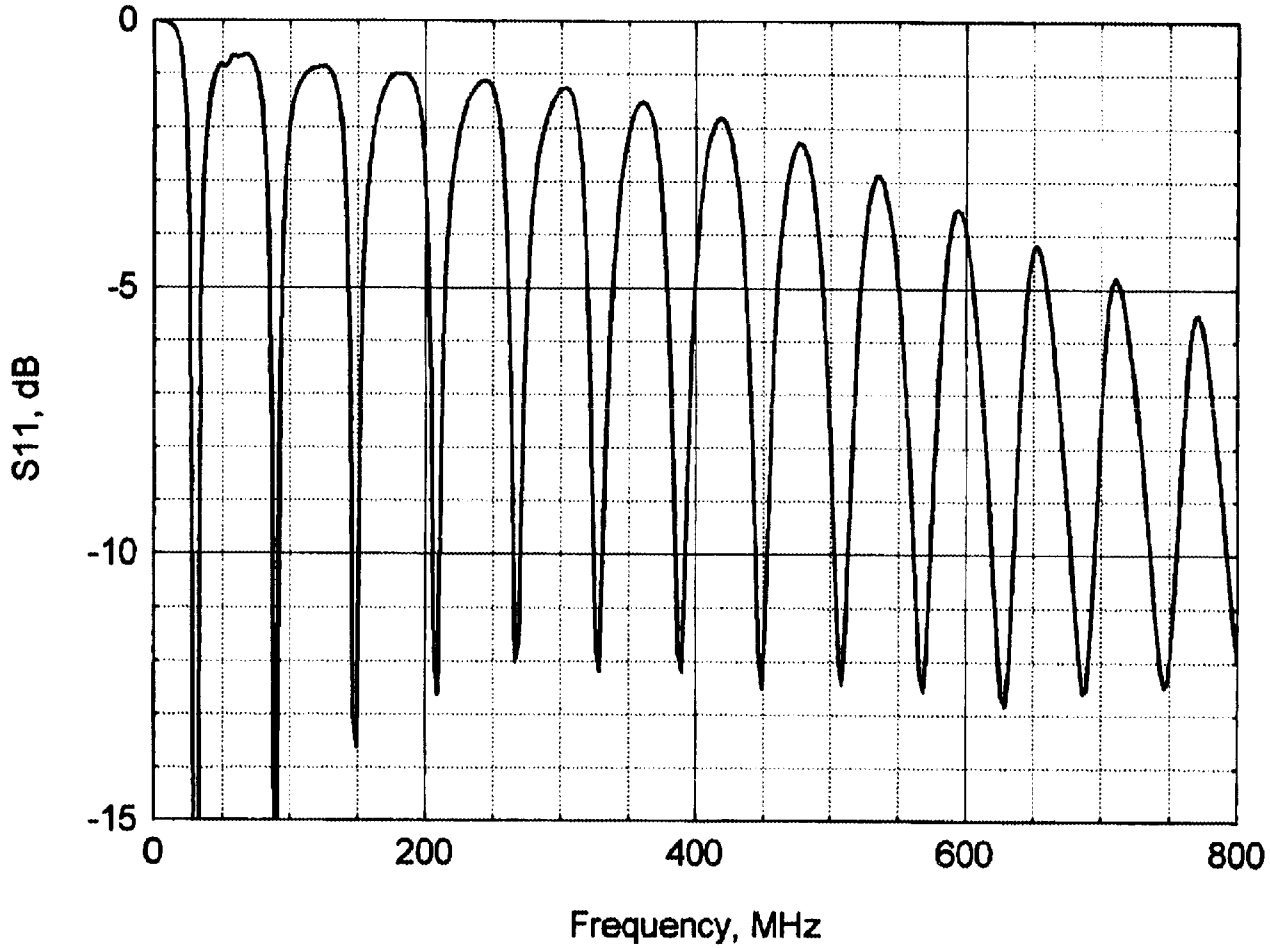
Figure 6. Return Loss of 8-foot Vertical Whip inserted into small 3-inch Base. Measured 2-17-00

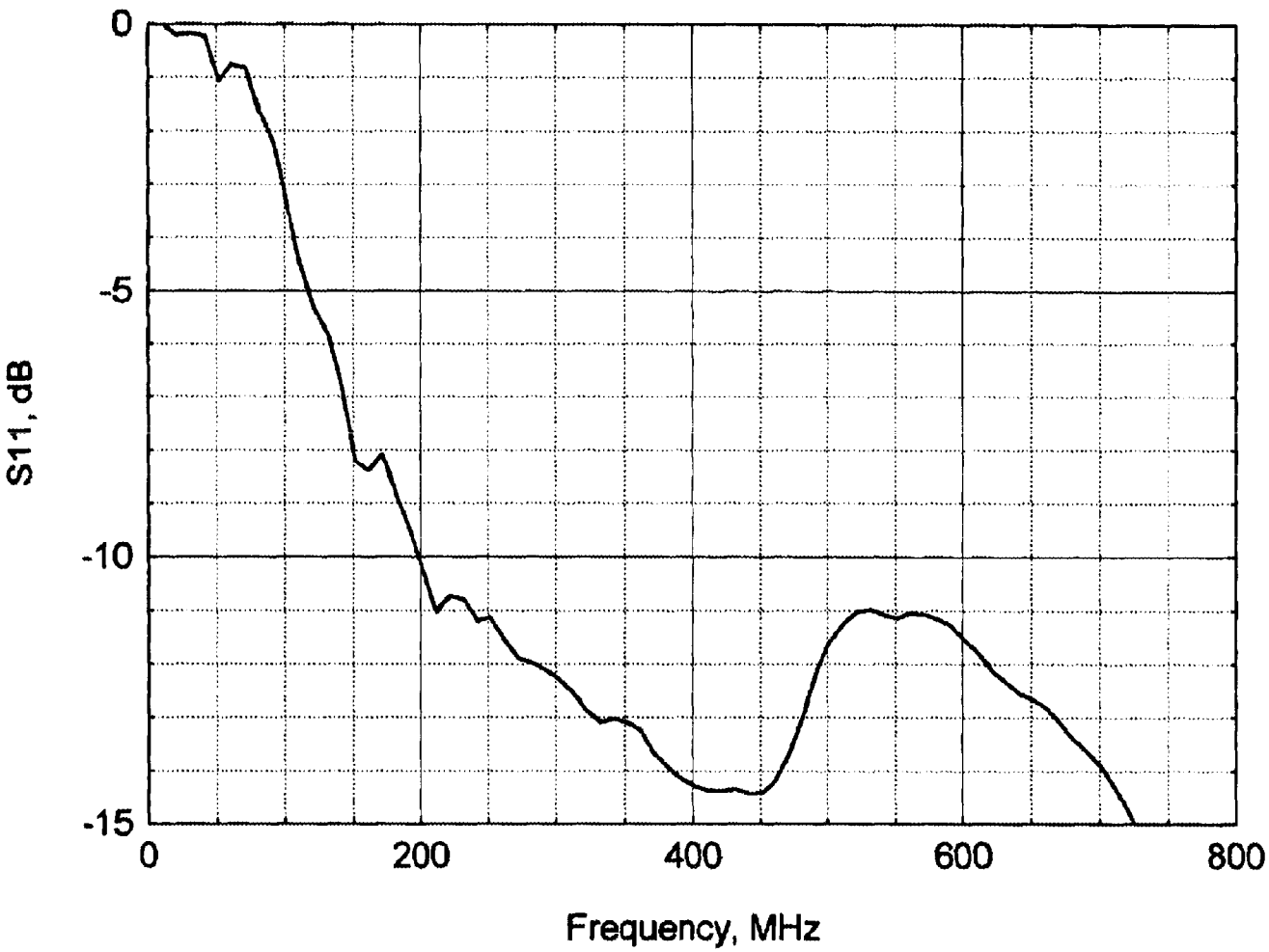
Figure 7. Return Loss of 20-inch Monocone. Measured 2-07-00

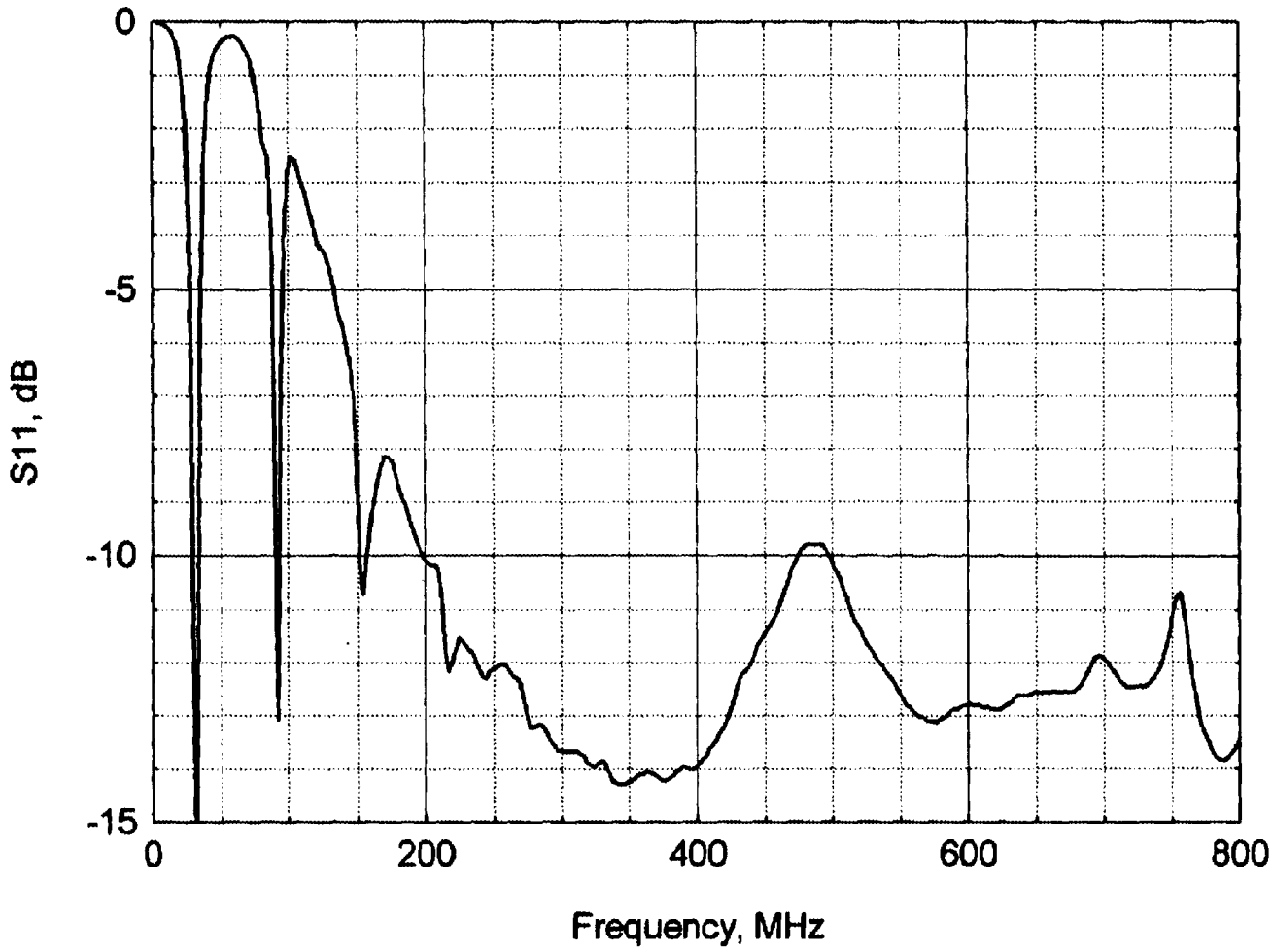
Figure 8. Return Loss of 8-foot Vertical Whip Combined with 22-inch Monocone. Measured 2-17-00.

ULTRA-BROADBAND ANTENNA ACHIEVED BY COMBINING A MONOCONE WITH OTHER ANTENNAS

This application is a Continuation-In-Part of Ser. No. 09/676,671 filed Nov. 24, 2000 now abandoned.

This invention was made with United States Government Support under contract number 67004-99-C-0045 awarded by the United States Marine Corps, the United States has certain rights in this invention.

BACKGROUND OF THE INVENTION

1. Field of the Invention

The present invention relates generally to antennas for transmitting and receiving electromagnetic radiation, and more particularly, to a monocone antenna combined with one or more other antennas and all are fed from a single RF feed point. This antenna effects highly efficient transmission and reception of electromagnetic radiation over a very wide range of frequencies.

2. Description of the Prior Art

Antennas for transmitting and receiving radiation in the form of a monocone, also known as a conical monocone or a conical monopole or a unipole is known.

Also known is a discone antenna which is a combination of a disk and a cone antenna, as differentiated from a monocone. A conical skirt monopole is also very similar to a discone.

The *Antenna Engineering Handbook* (1984), Section 26-4, by Johnson and Jasik describe a conical monocone and an inverted cone as broadband monopole antennas, and in Section 27-4 describe discone antennas. Rudge, et. al., in the *Handbook of Antenna Design* (1986) on pages 1378–9 describes a conical monopole and a double-cone monopole, and on pages 1427 and 1432 describe discone antennas. These two handbooks also describe thin monopole "whip" antennas, and inverted-L antennas.

*Balanis in Antenna Theory and Analysis* (1982) on page 330 describes a Unipole, which is the same as a monocone, and on pages 330–332 describes Triangular Sheet, Bow-Tie, and Wire Simulation antennas, and on page 346 describes Discone and Conical Skirt Monopoles. C. M. Knop and R. Frazer also disclose and study a monocone in "*A Study of Small-Height HF Jarriming Antennas for Vehicular Use*", pages 267–274 of *Microwave and Optical Technology Letters*, Vol. 13, No. 5, December 1996.

U.S. Pat. No. 6,198,454 issued to Sharp teaches direction finding antennas using monocones and bicones. Claims 1–7 of Sharp only claim a single antenna (monocone or bicone), there is no second or additional radiators in claims 1–7. In claims 1–12 Sharp never claims a full 360 degree monocone or bicone, only sectors of a cone, or flat antennas, only in claim 13 does Sharp claim a full 360 structure but gives no specifics regarding the structure, only describing it by it's performance.

In claims 8 thru 13 and FIGS. 6 & 7 Sharp U.S. Pat. No. 6,198,454 describes a direction finding array antenna. Sharp describes that different signals are received at a receiver from different antennas of the Sharp array, so that these signals may be compared. This would not be possible if the signals from all the antennas in the array were combined at one RF feed port into one feed transmission line.

See Sharp col. 1 lines 36–40 which states "Direction finding antenna arrays determine direction by comparing the phase or strength of signals received at different antennas."

Also see column 8 lines 20–26 which states "direction finding arrays generally operate by comparing the phase of the signals received by antennas arranged in an array. Information about direction may also be derived from the amplitude of the signals received from antennas facing in different directions in an array".

Also see column 2 lines 52–53 "measuring the phase of the signals from the plurality of direction finding antennas."

It is clear from these statements that Sharp separately measures the phase and/or amplitude of more than one antenna in his array so they can be compared. This is not possible with only one feed transmission feed line used simultaneously for the entire array antenna. Multiple feed transmission lines are used, each to a different part of the array. These may be all connected to a switch, but the RF signals are not combined simultaneously when receiver needs to make a comparison.

Therefore, in Sharp FIGS. 6 and 7 and claims 8 thru 13, multiple antennas are used with multiple feed transmission lines to different parts of the antenna. The lines drawn in FIGS. 6 & 7 connecting the different antennas simply represent the feed transmission lines as they are each connected to each antenna. Those lines do not represent that the feed transmission lines or the antennas are all electrically connected to each other. Each portion or each antenna of the Sharp array has a separate RF port with separate feed transmission line from each antenna to the receiver.

Unlike Sharp U.S. Pat. No. 6,198,454 our antenna has one single feed transmission line from the receiver/transmitter to the entire antenna. Our single feed transmission line from the receiver/transmitter feeds our monocone, the signals from our entire structure, including all antennas, is received simultaneously at this single RF feed port at all times. Our additional radiators are always connected to the first radiator (our first radiator being the monocone).

A last consideration regarding Sharp U.S. Pat. No. 6,198,454: our provisional patent Application No. 60/156,948 filed on Sep. 30, 1999 describes our antenna, the date of this report is Jul. 5, 1999 which pre-dates the Sharp application date of Jul. 16, 1999.

U.S. Pat. No. 5,990,845 issued earlier to Sharp recites, in claims 1 through 16 and claims 19 through 23, a single partial cone fan antenna, there is no second antenna or plurality of antennas in these claims. Claim 17 and 18 of Sharp U.S. Pat. No. 5,990,845 does claim a second partial cone which is a reflection of the first partial cone, to form a single bicone which is a well known type of antenna consisting of two monocones arranged with apexes close together. These two monocones comprising the bicone are not electrically connected to each other, and this antenna is not fed from the apex of a single monocone since it is fed using the apex of both monocones, and there is no additional antenna connected to this bicone. Moreover, all the claims of Sharp U.S. Pat. No. 5,990,845 explicitly claim a partial cone shape, ie cone sweep angle less than 360 degrees. None of the claims claim a full 360 degree monocone or bicone.

U.S. Pat. No. 5,038,152 issued to Wong describes a dielectric rod antenna. In the field of the invention Wong states that: "More specifically, this invention relates to dielectric rod antennas". Claim 1 of Wong specifically refers to a tapered dielectric rod extending through said aperture". The primary radiator in Wong is a dielectric rod and the dielectric rod is the first antenna fed from Wong's feed aperture, the monocone is not the, primary radiator. In our invention the monocone is the primary radiator and is the first antenna fed. In Wong the other radiators (Wong's parasitic elements 32, 34, 36, and 64) are not electrically connected to the monocone, they are connected to a mast which is connected to the dielectric rod, the mast is not connected to the monocone (claims 1,2,3,4). In Wong the monocone is not inverted, in our invention the cone is inverted with the apex fed at the ground plane. Wong does not use a ground plane. The feed structure and feed operation in Wong is completely different. Wong's invention is fed from a circular waveguide (claim 1), which is well known to be a hollow waveguide type of transmission line with no center conductor. Energy is coupled from the circular waveguide to Wong's dielectric rod. Wong's cone is connected to rim or to the outside of the circular waveguide. This is not how a monopole or monocone is typically fed. Our monocone is fed from the center conductor of a coaxial type of transmission line, in the manner in which a monopole antenna is typically fed. Our monocone is not connected to the rim or outside of the coaxial feed line. In Wong, the monocone is located below the feed aperture point, with the other radiators (the tapered dielectric rod and the parasitic elements) located above the feed aperture point. In our antenna the monocone and all other antennas are located above the feed point. The monocone in Wong is therefore more similar to the cone used in a discone antenna than to the monocone in our invention. In Wong the monocone functions to redirect the electrical energy, it is electrically more similar to a ground plane or reflector. In our invention the monocone functions as the primary radiator, not as a redirector or conical ground plane.

U.S. Pat. No. 3,534,378 issued to Smith teaches a wide band antenna for producing substantially omnidirectional horizontal coverage and an upwardly tilted torodial vertical coverage. The Smith antenna has, in combination, a cylindrical conductive means of length corresponding substantially to the half-wavelength of a frequency at the low end of the specified wide band with ground plane means comprising a plurality of substantially co-planar conductors of different lengths providing paths of substantially the half-wavelengths of frequencies at both the low and high end of the said wide band and slightly spaced from one end of the cylindrical conductive means to define a slot there between. Smith also describes current suppressing means a distance from one end corresponding substantially to a half-wavelength of a frequency at high end of the band in order to suppress the propagation of such high frequency currents and also describes a means for simultaneously feeding currents of different frequencies lying within the band between the ground plane and one end of the cylindrical conductive means across the slot. Smith teaches that the ground plane conductors comprise spaced radially conductors.

U.S. Pat. No. 3,618,107 issued to Spanos teaches a broadband discone antenna arrangement achieved by combining an auxiliary conical element coaxially mounted with respect to the axis of the first conical element (main cone) and the center of the disc element, and situated there between. Said second conical element is fed by the inner surface of the outer conductor of the coaxial transmission feed line.

Neither Sharp nor Wong nor Smith nor Spanos nor others known teach that a monocone on any suitable ground plane can be electrically connected to one or more additional antennas, all fed simultaneously from a single feed point, using a single feed transmission line, to achieve larger bandwidth and greater efficiency at equivalent or smaller size than would said antennas when employed as individuals. Nor is it anywhere taught to impedance match, not suppress, high frequency currents by electrically connecting the monocone with additional antennas described herein close to the common RF feed point. Further the inventive antenna described herein requires no choke, as taught by Smith and others.

Thus, while the foregoing body of prior art indicates it to be known to use monocone antennas, the prior art does not teach or suggest a monocone antenna combined with one or more additional antennas in such a way as described herein thus to be used to achieve broader band transmission or reception than when each antenna is used individually. This also results in a more compact and cost effective device than the monocone and the other antennas constructed and used individually.

The disadvantages of the foregoing are overcome by the unique antenna design of the present invention as will be made apparent from the following description thereof. Other advantages of the present invention over the prior art also will be rendered evident.

SUMMARY OF THE INVENTION

An ultra broadband antenna is provided by combining a monocone antenna with one or more additional antennas described herein, and all are connected together electrically near a single feed point for the entry and exit of radio frequency (RF) electromagnetic signals to and from the antenna. The said feed point is at the apex of the monocone. The inventive combination antenna has a greater frequency bandwidth than the monocone, and greater bandwidth than any of the other antennas when employed singly.

It is known that an antenna may be either a radiator or receiver of electromagnetic signals, also generally referred to as "radio frequency" (RF) signals. The feed point of the antenna is the locus of where the electromagnetic signals are fed to and received from said antenna, said electromagnetic signals being those radiated from or received by the antenna.

Further it is known that a monocone antenna may be constructed of one or more conductors defining a conical surface, and that the conductor or conductors forming the monocone may be solid; partially solid; a surface; a wire grid; or wires connected near the apex of the monocone; or an array of conductors disposed conically about a common feed point; and each of the wires or conductors in the array need not be of the same length in defining said cone. A monocone with a full flare angle of less than approximately 5 degrees is essentially the same as a monopole.

The ultra-broadband antenna of the invention is formed by combining a first radiator, which is a monocone, with one or more additional antennas referred to herein as additional radiators or as the second and subsequent additional radiators. The additional radiators may be the same type as each other or of different type from each other. The additional radiators are typically selected from the group consisting of monopole, whip antenna, loaded monopole, top-loaded monopole, triangular sheet antenna, fan monopole, inverted L antenna, and loop antenna.

The additional radiators are affixed to the first radiator and are electrically connected close to the feed point of the first radiator, this would include being connected to the first radiator at an electrically small distance from the feed point to the first radiator. "Electrically close" and "electrically small distance" are defined here as much less than one wavelength at the lowest frequency of operation, for example 0.15 wavelengths would be electrically close. This electrical connection is a direct physical connection, not by a length of transmission line. An electrical connection at radio frequencies could include a path for conduction current or a path for significant "displacement" current, ie capacitive or inductive coupling.

The additional radiators are typically 50% or more longer than the monocone so that the monocone provides the impedance match to 50 ohms at the higher frequencies and the additional radiators provide operation at some lower frequencies.

The above brief description sets forth rather broadly the more important features of the present invention in order that the detailed description of embodiments thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide an ultra-broadband antenna by combining a monocone with several other antennas, either singularly or in combination therewith.

It is an object of the present invention to provide an ultra-broadband antenna including means for utilization with any ground plane or ground structure suitable for a monocone and the additional radiators. It is an object of the present invention to provide an ultra-broadband antenna which can be conveniently mounted on vehicles: including automobiles, trucks, ships, aircraft, spacecraft, missiles, satellites or such acting as a ground plane for the antenna.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

The invention will be better understood and the above objects as well as objects other than those set forth above will become more apparent after a study of the following detailed description thereof. Such description makes reference to the annexed drawings wherein:

FIG. 6 is a plot of measured return loss (S11) for a previously disclosed 8-foot vertical whip antenna.

FIG. 7 is a plot of measured return loss (S11) for a previously disclosed monocone.

FIG. 8 is a plot of measured return loss (S11) for an examples antenna of the invention with a monocone combined with an 8-foot whip as shown in FIGS. 1, 2 and 4.

DESCRIPTION OF THE PREFERRED EMBODIMENT

With reference now to the drawings, an ultra-broadband antenna 10 embodying the principles and concepts of the present invention will be described.

Figure 1:
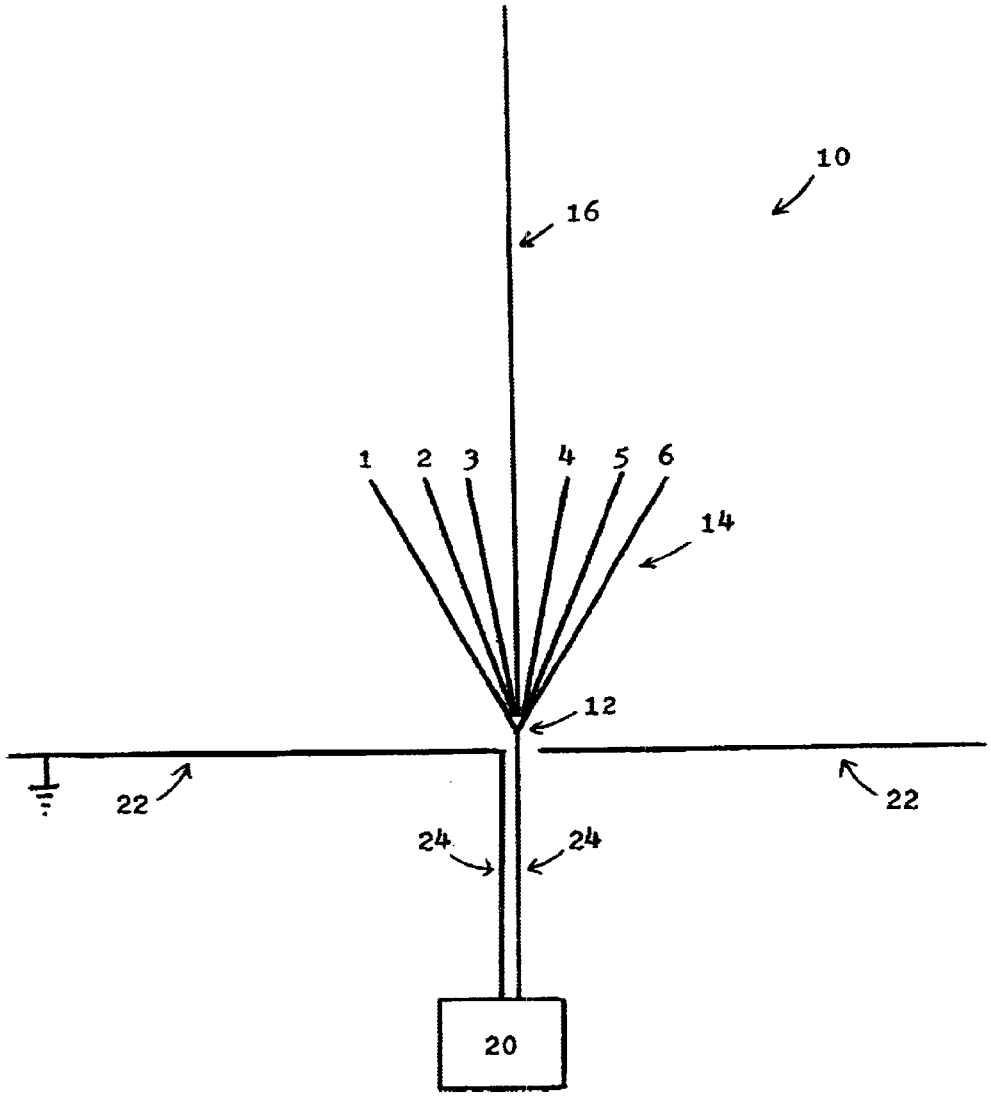
FIG. 1 is a side view illustrating a first embodiment of the ultra-broadband antenna of the instant invention showing the first radiator as a monocone comprised of an array of linear conductors, and also showing a second radiator illustrated as a single longer whip antenna.
Figure 2:
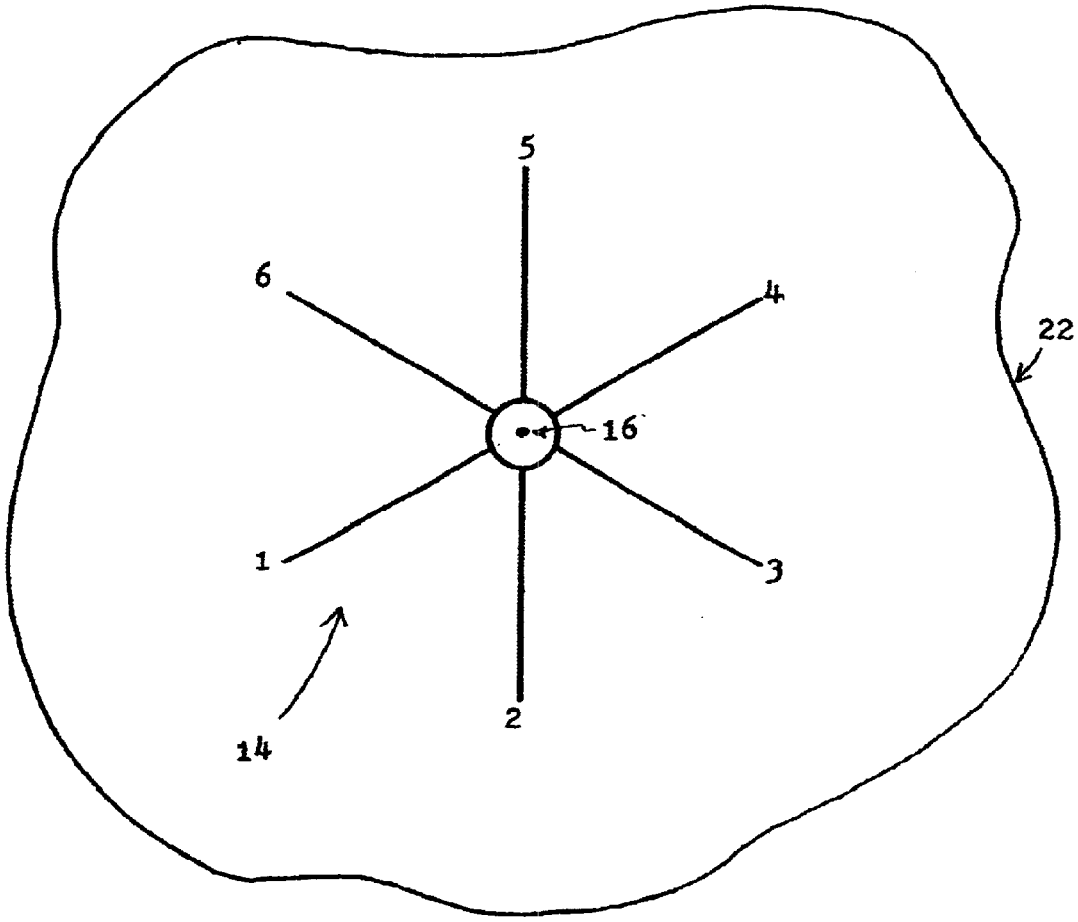
FIG. 2 is a top view of FIG. 1 of the ultra-broadband antenna.
Figure 3:
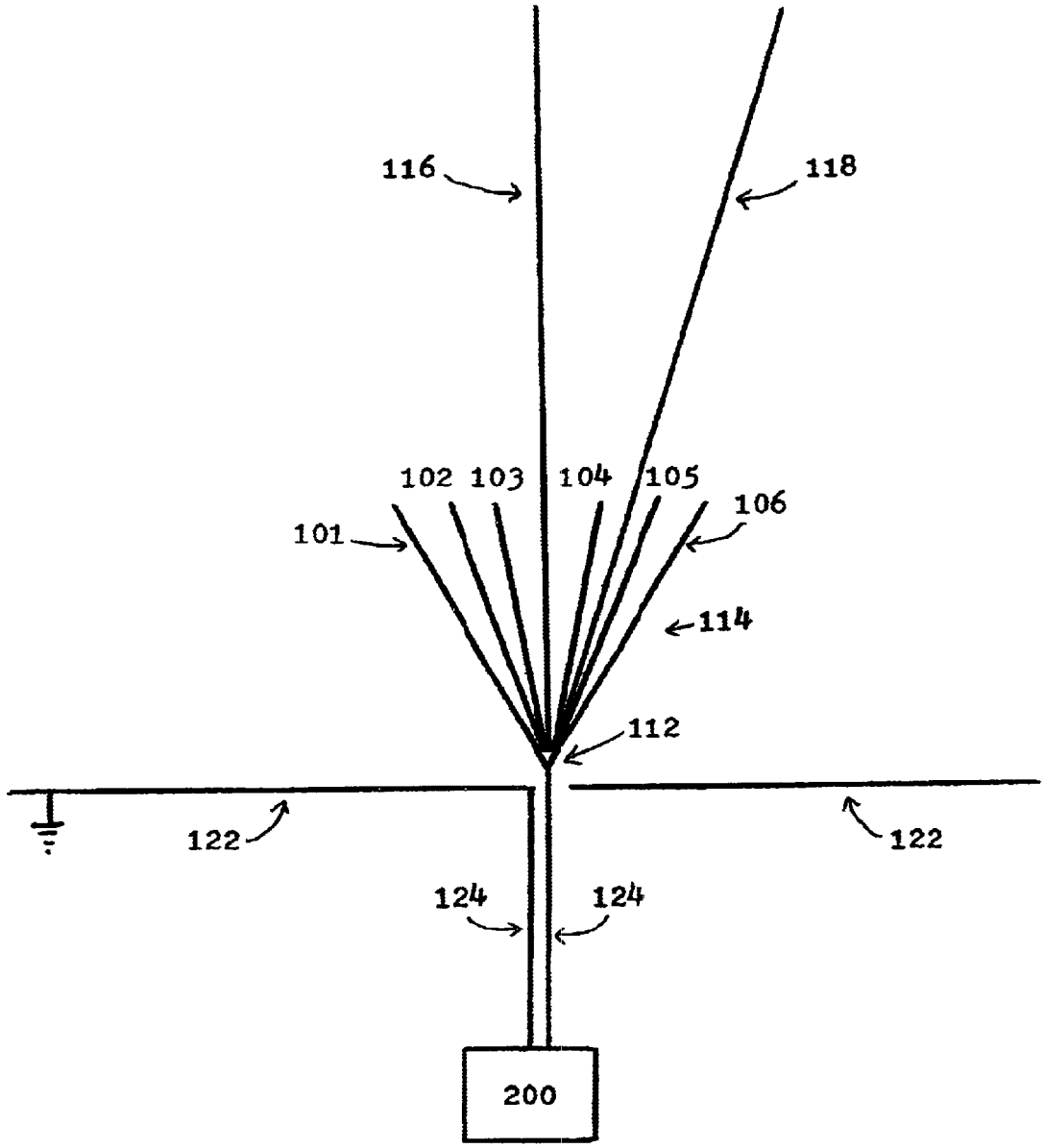
FIG. 3 is a side view illustrating of the ultra-broadband antenna invention showing a first radiator as a monocone comprised of an array of linear conductors, and also showing a second radiator and a third radiator which are both illustrated as whips of longer length than the monocone.

In the description of FIGS. 1 to 3 the term fed and feed are used. This term is to be understood to both provide a signal or receive a signal.

Turning now to FIG. 1, there is shown the ultra-broadband antenna of the invention generally designated by reference numeral 10. In its preferred form, ultra-broadband antenna 10 includes a first radiator here consisting of a monocone antenna 14 comprised of it's component conductors, for example, 1, 2, 3, 4, 5, 6. The component conductors of the monocone 1, 2, 3, 4, 5, 6 are arranged in a conical way about feed point 12 to form.a monocone. Component conductors 1, 2, 3, 4, 5, 6 of the monocone are illustrated to be the same length, but may each be of various lengths to achieve the monocone. The illustrated monocone in FIG. 1 is not necessarily composed of individual conductors 1, 2, 3, 4, 5, 6; but may be solid, partially solid, a surface, or a grid disposed to form a cone. The illustrated monocone is fed from said common feed point 12, located near the monocone's apex. Feed point 12 is connected to transmitter/receiver 20 by a single feed transmission line 24 through ground 22. Ground 22 may be either a ground plane or ground radials.

Second radiator 16 is not a component of the monocone. Radiator 16 is illustrated as a larger whip radiator. Radiator 16 is affixed to and electrically connected to the monocone, close to common feed point 12.

FIG. 2 is a top view of the antenna in FIG. 1 illustrating the emanation of radiator 16 and individual conductors of monocone 14 from feed point 12 surrounded by ground 22.

FIG. 3 illustrates the first radiator which is monocone 114 and second radiator 116 with third radiator 118, with common feed 112. Again, feed point 112 is connected to transmitter/receiver 200 by single feed transmission line 240, through ground 122. Ground 122 may be either a ground plane or ground radials.

Radiators 116 and 118 do not form part of the monocone. Radiators 116 and 118 are illustrated as larger whip radiators. Radiators 116 and 118 are affixed to and electrically connected to the monocone, close to common feed point 112. Radiator 118 may be different type of radiator than radiator 116. Additionally, radiator 118 may be the same type of radiator as 116.

The monocone 114 component conductors 101, 102, 103, 104, 105 & 106 are shown. Individual conductors 101,102, 103,104, 105, & 106 are illustrated to be the same length, but may each be of various lengths to achieve the monocone. The illustrated monocone in FIG. 3 is not necessarily composed of individual conductors 101, 102, 103, 104, 105, & 106, but may be solid, partially solid, a surface, or a grid disposed to form a cone.

FIGS. 6, 7 and 8 show the performance improvement obtained with this invention. FIGS. 6, 7 and 8 plot the measured return loss (S11). A low return loss is highly desirable for most antennas since it creates a passband, which is a frequency band over which the antenna can most efficiently transmit and/or receive. Return loss is a very significant parameter for most antennas since it is a measure of the fraction of electromagnetic energy reflected from the antenna when the antenna is fed from a transmission line. The lower the return loss (S11) the less energy is being reflected back to the transmitter, so a low return loss is desirable. FIGS. 6, 7 and 8 show that an antenna of the invention of FIGS. 1, 2, 4 and 8, provides superior passband performance compared to the performance of either one of its two component radiators operating alone, shown in FIG. 6 and 7.

FIG. 6 shows typical measured return loss for a single 8-foot high vertical whip antenna which is a previously disclosed antenna in widespread use. It is seen that the return loss is low only for very narrow frequency bands. This type of antenna is usually used at the first passband in the return loss which is seen to occur near 30 MHz, and this antenna is seen not to provide a very wide frequency bandwidth.

FIG. 7 shows return loss for a monocone only. There is no second radiator here since it is a monocone only. FIG. 7 shows that the measured return loss for the monocone alone reaches a low level at frequencies above about 150 MHz, but the passband notch near 30 MHz is absent.

Figure 4:
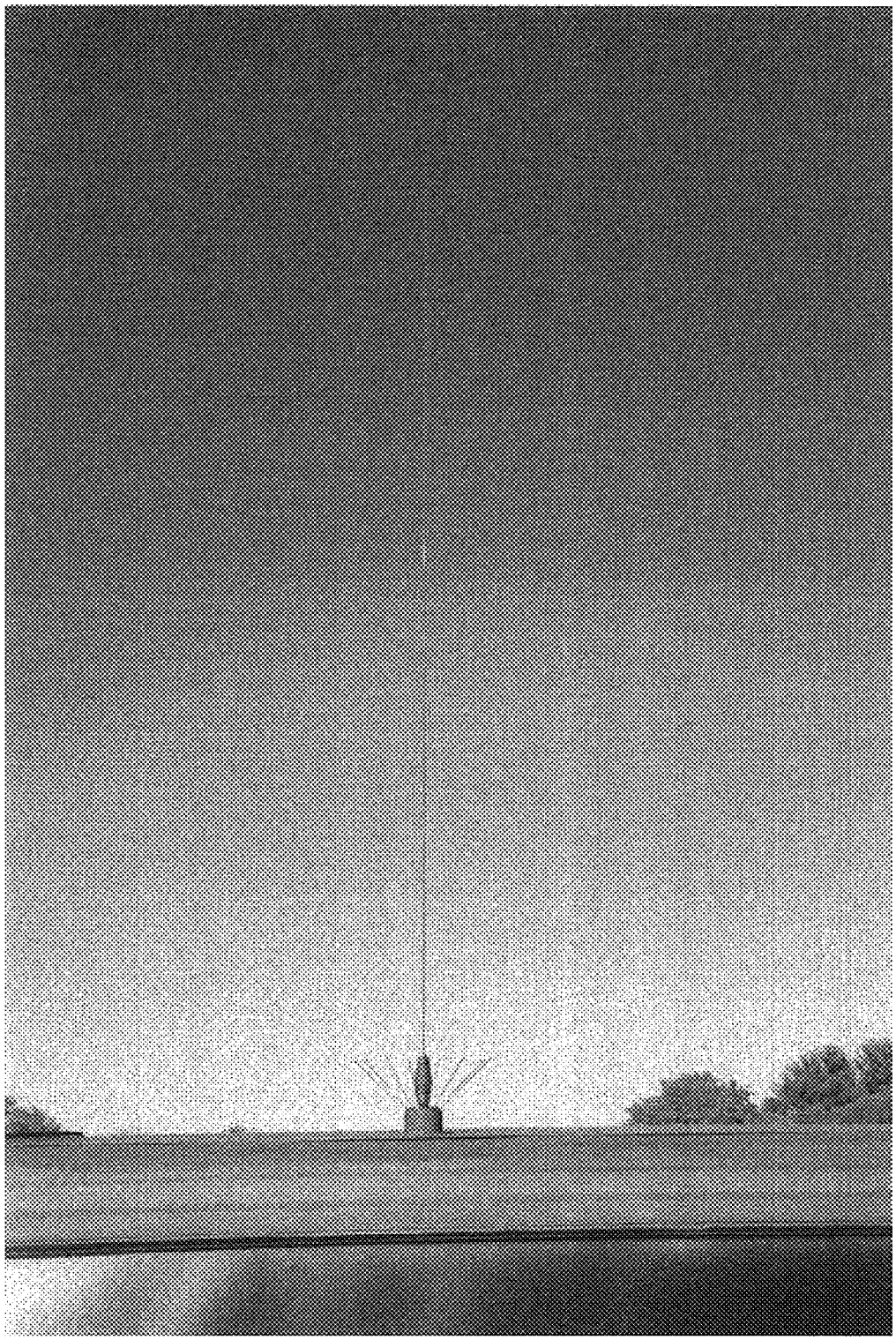
FIG. 4 is a photograph of an antenna of the embodiment of FIGS. 1 and 2 of the ultra-broadband antenna.
Figure 5:
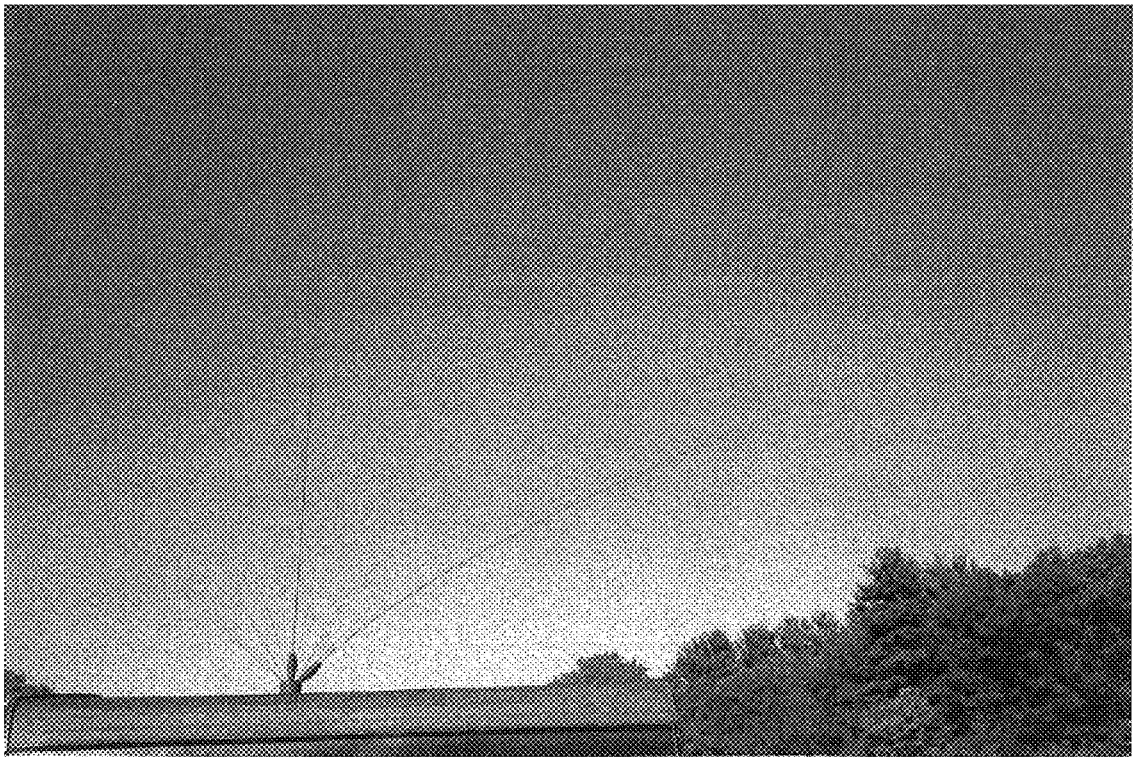
FIG. 5 is a photograph of an antenna of the embodiment of FIG. 3 of the ultra-broadband antenna.

FIG. 8 shows return loss for an antenna of the invention shown in FIGS. 1, 2 and 4. For this antenna the first radiator is a monocone with a slant length of 22 inches (similar to that used for FIG. 7). This monocone is combined with the second radiator which is a single vertical whip that is 8-feet high. FIG. 8 shows much improved passband characteristics for this novel antenna. The measured return loss for the antenna of the invention is low over a much wider frequency range than for the 8-foot whip alone which was shown in FIG. 6. The frequency passband near 30 MHz is maintained in both FIG. 6 and FIG. 8, and in addition, FIG. 8 shows that the antenna of the invention has a passband at all frequencies above about 150 MHz, which is a great improvement in performance compared to the 8-foot whip alone shown in FIG. 6.

All antennas and radiators for this test were fabricated from conducting metals (aluminum and steel) and the ohmic losses are small for all three antennas at the frequencies measured, so the ohmic loss has not contributed significantly to the low return losses shown.

It is apparent from the above that the present invention accomplishes all of the objectives set forth by providing an ultra-broadband antenna by combining a monocone or bicone with several other antennas, either singularly or in combination therewith, each of which may be of a different type, which has advantages not equivalently available in the prior art.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. An ultra broadband antenna for communicating electromagnetic energy including:

a) a first radiator consisting of a monocone;

b) at least one additional radiator, said additional radiators do not form part of said monocone and do not conform to or approximate the conical shape or conic surface of said monocone, but said additional radiators are made of conductive material and are directly affixed to said monocone and are electrically connected to said monocone, and said additional radiators are selected from the group consisting of monopole, whip antenna, loaded monopole, top-loaded monopole, fan monopole, inverted L antenna, and loop antenna;

c) a single feed point located at the apex of said monocone, said feed point being the locus of where electromagnetic signals from the entire said antenna are fed to and from a single feed transmission line on both transmit and receive.

2. The ultra broadband antenna as recited in claim 1 wherein said additional radiators are any type of conductive antenna except: a monocone, plate, disk, or rim with radial spokes.

3. The ultra broadband antenna as recited in claim 1 wherein said additional radiators are any type of conductive antenna except: a monocone with a full flare angle greater than 5 degrees, plate, disk, or rim with radial spokes.

4. The ultra broadband antenna as recited in claim 1 wherein one or more of said additional radiators is a conductive monocone with any full flare angle.

5. The ultra broadband antenna as recited in claim 1 wherein said additional radiators are electrically connected to each other in addition to being electrically connected to the first radiator.

6. The ultra broadband antenna as recited in claim 1 wherein some of said additional radiators are electrically connected to each other, and not all of these additional radiators are electrically connected directly to the first radiator, as long as these additional radiators are electrically connected to the first radiator by passing through an additional radiator.

7. The ultra broadband antenna as recited in claim 1 wherein said additional radiators are all selected to be the same type of antenna.

8. The ultra broadband antenna as recited in claim 1 wherein said additional radiators are selected to be different types of antennas.

* * * * *